US010465437B2

(12) United States Patent
Little et al.

(10) Patent No.: US 10,465,437 B2
(45) Date of Patent: Nov. 5, 2019

(54) STORM SHIELD FOR BATHING STRUCTURE

(71) Applicant: LCR Innovations, LLC, Brentwood, TN (US)

(72) Inventors: William R. Little, Franklin, TN (US); Henry Ross, Brentwood, TN (US)

(73) Assignee: LCR Innovations, LLC, Brentwood, TN (US)

( * ) Notice: Subject to any disclaimer, the term of this patent is extended or adjusted under 35 U.S.C. 154(b) by 8 days.

(21) Appl. No.: 15/818,804

(22) Filed: Nov. 21, 2017

(65) Prior Publication Data

US 2018/0128038 A1 May 10, 2018

Related U.S. Application Data

(62) Division of application No. 14/815,793, filed on Jul. 31, 2015, now Pat. No. 9,879,473.

(60) Provisional application No. 62/031,598, filed on Jul. 31, 2014.

(51) Int. Cl.

| | |
|---|---|
| ***E06B 5/00*** | (2006.01) |
| ***A47K 3/00*** | (2006.01) |
| ***E04H 9/00*** | (2006.01) |

(52) U.S. Cl.

CPC ..... *E06B 5/003* (2013.01); *A47K 3/001* (2013.01); *E04H 9/00* (2013.01)

(58) Field of Classification Search

CPC ..... E04H 9/00; A47K 3/001; E06B 5/003

USPC ..... 4/498, 580, 546, 609

See application file for complete search history.

(56) References Cited

U.S. PATENT DOCUMENTS

| | | | | |
|---|---|---|---|---|
| 2,958,083 | A * | 11/1960 | Shook | B63B 19/21 160/193 |
| 5,044,022 | A * | 9/1991 | Hess | E04H 4/101 4/502 |
| 5,761,750 | A * | 6/1998 | Mazzola | E04H 4/082 4/500 |
| 9,879,473 | B1 * | 1/2018 | Little | E06B 5/003 |
| 2006/0236450 | A1 * | 10/2006 | Shanks | A47K 3/001 4/580 |
| 2009/0025135 | A1 * | 1/2009 | Huber | E04H 4/082 4/498 |
| 2014/0150174 | A1 * | 6/2014 | Erickson | A47K 3/001 4/580 |

* cited by examiner

*Primary Examiner* — Huyen D Le

(74) *Attorney, Agent, or Firm* — Waller Lansden Dortch & Davis LLP; Matthew C. Cox

(57) ABSTRACT

A storm shield apparatus for protecting persons, animals, or property within a bathing structure includes a retractable shield that is selectively moveable between a stowed position and a deployed position. The shield is moveable along first and second tracks. In some embodiments, the first and second tracks are disposed on opposing longitudinal end walls proximate the bathing structure, and the shield includes flexible roll-top shield sections. A trough with multiple panels may be positioned under the bathing structure to provide an additional barrier to prevent flying debris from penetrating the bathing structure from its sides, longitudinal ends or bottom. The trough mates with the shield in some embodiments to form a protective enclosure.

20 Claims, 12 Drawing Sheets

STORM SHIELD FOR BATHING STRUCTURE

CROSS-REFERENCE TO RELATED APPLICATION

The present application is a divisional application which claims priority to U.S. Non Provisional application Ser. No. 14/815,793 titled "Storm Shield For Bathing Structure" filed Jul. 31, 2015, which claims priority to U.S. Provisional Patent Application No. 62/031,598 titled "Storm Shield for Bathing Structure," filed Jul. 31, 2014, both of which are hereby incorporated by reference in their entireties.

BACKGROUND

The present disclosure relates generally to protective structures for securing persons, animals, or property. More particularly, the present disclosure relates to storm shelter apparatuses for use inside buildings such as homes and businesses.

Various types of protective enclosures for use as storm shelters are generally known in the art. Most conventional storm shelters are subterranean structures that form an enclosure that people seek shelter in during storms. Conventional subterranean storm shelters are generally too expensive for many people. Additionally, subterranean storm shelters require available land for installation. Conventional subterranean shelters are often difficult to use, obtrusive, messy, and take a long time to install.

Many homes have no dedicated storm shelters either in the home or within a reasonable distance thereof due primarily to installation and material costs of traditional subterranean shelters. Others have attempted to develop above-the-ground storm shelters. However, conventional above-the-ground storm shelters are often expensive and often do not include an aesthetically pleasing exterior. Additionally, above-the-ground storm shelters may be difficult to access during a storm when people are inside a building and must go outside to get to the exterior storm shelter.

As a consequence, residents are often forced to identify and temporarily occupy a structurally enhanced portion of a residence or office as a shelter during severe weather. The dangers associated with disasters such as hurricanes, tornadoes, earthquakes, and storms often include the potential for flying debris and/or the collapse of building materials. Many safety guidelines for severe weather instruct individuals to move to a basement, closet, or bathtub during bad weather. In such situations, individuals often get in a bathtub due to the relative strength of the bathtub wall materials. However, one problem with this solution is that bathtubs are open on the top. Therefore, although bathtubs may offer reinforced material to protect from the sides, bathtubs generally do not protect from debris falling from above.

In further applications, people may seek temporary shelter inside a building in a shower. Showers typically include tiled walls that may provide some protection in the event of a disaster such as a hurricane, tornado or earthquake. People may also seek protection in other reinforced areas such as stairwells or under desks. However, these solutions are inadequate in the event of a disaster because such structures may not fully enclose and protect individuals, animals, or property in the event of severe weather or disasters.

What is needed, then, are improvements to storm shelter structures for use inside buildings, including, but not limited to, homes, apartments, businesses, medical facilities, and offices.

BRIEF SUMMARY

The present disclosure provides a storm shield apparatus for use in a building such as a home, apartment, business, medical facility, or office.

The storm shield apparatus, or storm shelter apparatus, includes a retractable shield that a user may position over an opening in a bath structure, or bathing fixture, such as a bathtub or shower. The shield is moveable between a first stowed position allowing normal operation of the bathtub or shower and a second deployed position at least partially covering the bath structure.

The shield includes edges that are moveable along a track. The track may either be formed integrally into a structure surrounding the bathtub or shower, or in other embodiments the track includes a modular track component that is installed on the surrounding environment.

The track location may be customized to provide a variety of embodiments for the travel path of the shield between the stowed and deployed positions.

In some embodiments, the shield includes a reinforced material such as a metal or composite shield having a plurality of segments (e.g., plates) joined together at flexible joints to allow the shield to achieve a curved profile during use. In some embodiments, the shield may be housed in a wall and/or other structure, such as a shield housing. In some embodiments the shield can be rolled onto a spool that may or may not be housed within a shield housing. The shield that is in a stowed position, including shields that are on a spool or in a shield hosing, can be stored near or in the bathing structure when not in use. When the shield is needed, the shield may be moved along the track by a user to cover a portion of the bathing structure (e.g., tub or shower), including an opening of the bathing structure.

In the event of inclement weather, a user may get inside the bathing structure, or may place property or pets inside the tub or shower, and deploy the shield along the track. The space enclosed between the shield and the bathing structure provides a secure enclosure. The shield may be locked in position in the deployed (extended) and/or in the stowed (retracted) position.

In this regard, an object of the present disclosure is to provide a shield apparatus that may be used to protect people, animals, or property in the event of severe weather such as tornadoes or hurricanes. Another objective of the present disclosure is to provide a shield that may be used to protect people, animals or property during other disasters, such as earthquakes, wildfires, and/or home intrusions.

In some embodiments, the present disclosure provides a storm shield apparatus including a bathing structure and a shield positioned on the bathing structure. The shield has a first shield edge and a second shield edge opposite the first shield edge. A first track is positioned proximate the first shield edge, and a second track is positioned proximate the second shield edge. The shield is selectively moveable along the first and second tracks relative to the bathing structure between a stowed position and a deployed position.

In additional embodiments, the present disclosure provides a storm shield apparatus including a bathing structure, a first track, a second track opposite the first track, and a shield positioned on the bathing structure. The shield is selectively moveable relative to the bathing structure along the first and second tracks between a stowed position and a deployed position. The shield at least partially covers the bathing structure when the shield is in the deployed position to provide protection to persons, pets or property residing in the bathing structure.

In yet further embodiments, the present disclosure provides a shield apparatus comprising a structure that includes four sides and an opening configured to receive a bathing structure, where the four sides are defined by a first end plate, a second end plate, a first longitudinal plate, and a second longitudinal plate. The shield further includes a shield that is comprised of a plurality of segments that are adapted for telescopic movement between a retracted position and an extended position, and the shield includes a first longitudinal shield edge and a second longitudinal shield edge. The shield includes a first longitudinal track extending between the first plate end plate and the second end plate along a first longitudinal edge of the bathing structure, the first longitudinal track being configured to slidably receive the first longitudinal shield edge. The shield further includes a corresponding second longitudinal track that extends between the first end plate and the second end plate along a second longitudinal edge of the bathing structure, the second longitudinal track being configured to slidably receive the second longitudinal shield edge. In this manner, when the shield is in the deployed position in which the segments of the shield are extended, the shield covers a bathing structure opening.

Another object of the present disclosure is to provide a shield apparatus suitable for new construction or replacement or retrofitting of existing bathing structures such as showers and bathtubs. The shield may be used with single or multi-family units, new construction and/or retrofit and remodeling applications.

Another object of the present disclosure is to provide a storm shield for a bathing structure such as a bathtub or shower, the shield including interior illumination such as illumination by LED lights.

Another object of the present disclosure is to provide a storm shield for a bathing structure such as a bathtub or shower, the shield including ventilation ports and/or active ventilation using forced air flow. Forced air flow may be provided from a fan, reservoir of compressed gas, or the like.

Another object of the present disclosure is to provide a storm shield for a bathing structure such as a bathtub or shower, the shield including a Personal Locator Beacon or sounding alarm to notify rescue workers as to location.

Another object of the present disclosure is to provide a storm shield for a bathing structure such as a bathtub or shower, the shield including an emergency radio band-equipped radio to keep occupants apprised of storm conditions.

Another object of the present disclosure is to provide a storm shield for a bathing structure such as a bathtub or shower, the shield including an optional two-way communication system to enable direct contact with rescue workers or others.

Another object of the present disclosure is to provide a storm shield for a bathing structure such as a bathtub or shower, the shield made of readily available materials such as metals, porcelains, polymers, reinforced fiberglass, as well as optional innovative materials such as carbon composites in order to reduce weight.

Another object of the present disclosure is to provide a storm shield for a bathing structure such as a bathtub or shower, the shield including an integrated battery to power one or more devices listed above. Instructions may recommend semi-annual battery replacement similar to those being suggested for residential smoke and carbon dioxide detectors (daylight savings time changes).

A further object of the present disclosure is to provide a storm shield apparatus including a base plate as well as a first end plate that is spaced apart from a second end plate. A shield extends between the space provided between the first and second end plates, a first track is provided on the first end plate, a second track is provided on the second end plates. Furthermore, the space between the first and second end plates can receive a bathing structure, and the shield is moveable along the first and second tracks to selectively cover the bathing structure.

In some embodiments, the first and second tracks define a convex profile over the bathtub our outside a shower to provide arch strength to protect against falling and flying debris. In this regard, the first and second tracks define an arcuate path over the bathtub in some embodiments.

Further objects of the present disclosure provide a shield for a bathing structure. The shield includes a shield member selectively moveable relative to the bathing structure for covering the opening of the bathing structure.

Another object of the present disclosure provides a bathing structure including a wall beside the bathtub, a gap between the bathing structure and the wall, a track positioned adjacent the gap, and a retractable shield positioned to travel on the track, wherein the shield is extendable through the gap to cover the bathing structure.

A further object of the present disclosure provides a storm shield including a track in a wall or other structure along which a shield may travel to selectively cover a bathing structure.

Numerous other objects, features and advantages of the present disclosure will be readily apparent to those skilled in the art upon a reading of the following disclosure when taken in conjunction with the accompanying drawings.

DETAILED DESCRIPTION

Figure 1:
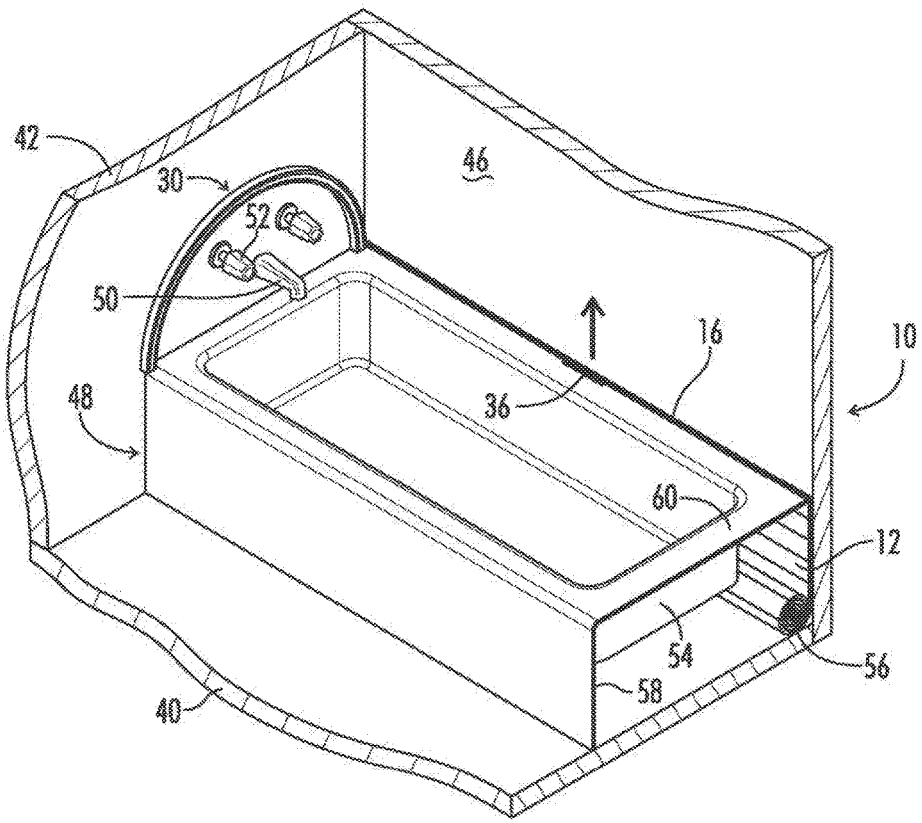
FIG. 1 illustrates a partial cross-sectional perspective view of an embodiment of a storm shield apparatus in a stowed position.

Referring now to the drawings, various embodiments of structural features associated with the present invention are generally illustrated and described. The embodiments shown in the drawings the description below are not intended to limit the scope of the Claims, and the illustrations are shown as exemplary embodiments of some modes of carrying out the claimed invention.

Referring to FIG. 1, an embodiment of a storm shield apparatus 10 is illustrated in a partial cross-sectional perspective view. Storm shield apparatus 10 includes a shield 12 that is selectively moveable to cover a bathing structure 48 such as a bathtub or shower. Shield 12 is selectively moveable between a stowed position and a deployed position. During everyday use of the bathing structure, the storm shield apparatus 10 is stowed and out of the way, and the storm shield apparatus does not interfere with normal operation of the bathing structure. In the event of inclement weather or natural disasters such as storms, hurricanes, earthquakes, tornadoes or other disruptive conditions, one or more people may enter the bathing structure and deploy the storm shield apparatus to cover and protect the space between the bathing structure and the storm shield. The storm shield protects the interior space from falling and wind-driven debris.

Referring to FIG. 1, storm shield apparatus is shown in a stowed position with a portion of shield 12 housed in a space between bathing structure 48, a floor 40 on which the bathing structure is mounted, and rear wall 46 against which bathing structure 48 is positioned. For example, conventional bathtubs include a space between the bathtub cavity 54 and the floor 40 and rear wall 46. The space provides a region for running plumbing, or is otherwise kept empty upon installation of the bathing structure. Storm shield apparatus 10 utilizes this space to house a stowable shield 12 may be selectively deployed from the space to provide a protective cover over the bathing structure. During a period of inclement weather, one or more persons or pets may get in the bathing structure 48 and then deploy the storm shield apparatus 10 from this space to provide a protective cover.

Figure 2:
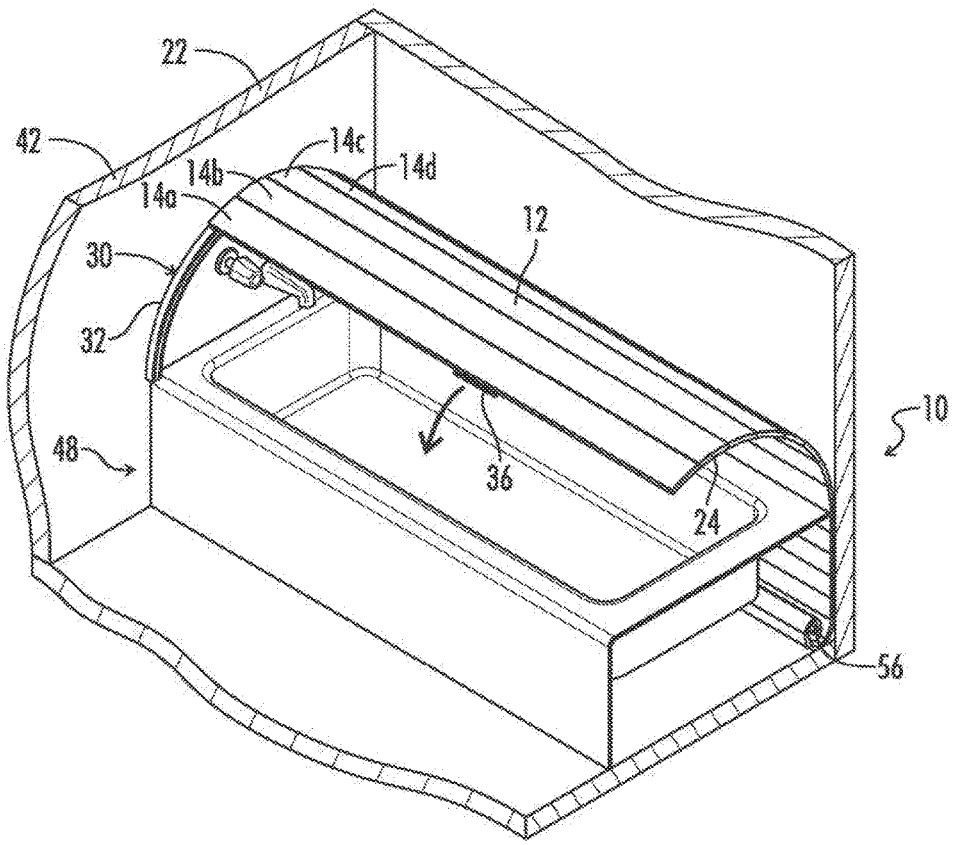
FIG. 2 illustrates a partial cross-sectional perspective view of an embodiment of a storm shield apparatus in a partially-deployed position.

Referring to FIG. 2, shield 12 is moveable along a track 30 during deployment and stowage. In some embodiments, shield 12 includes a multi-segment barrier made of multiple sections 14*a*, 14*b*, 14*c*, 14*d*, etc. forming a flexible shield similar to a roll-top desk. The multiple sections are joined together at longitudinal joints that allow each rigid section to flex relative to its adjacent sections. A handle 36 on shield 12 allows a user positioned in the bathing enclosure to manually lift the shield 12 and move shield 12 along the track 30 to cover the bathing enclosure. In additional embodiments, shield 12 is linked to a powered actuator and a control to allow a user to deploy and stow shield 12 using the control.

Figure 3:
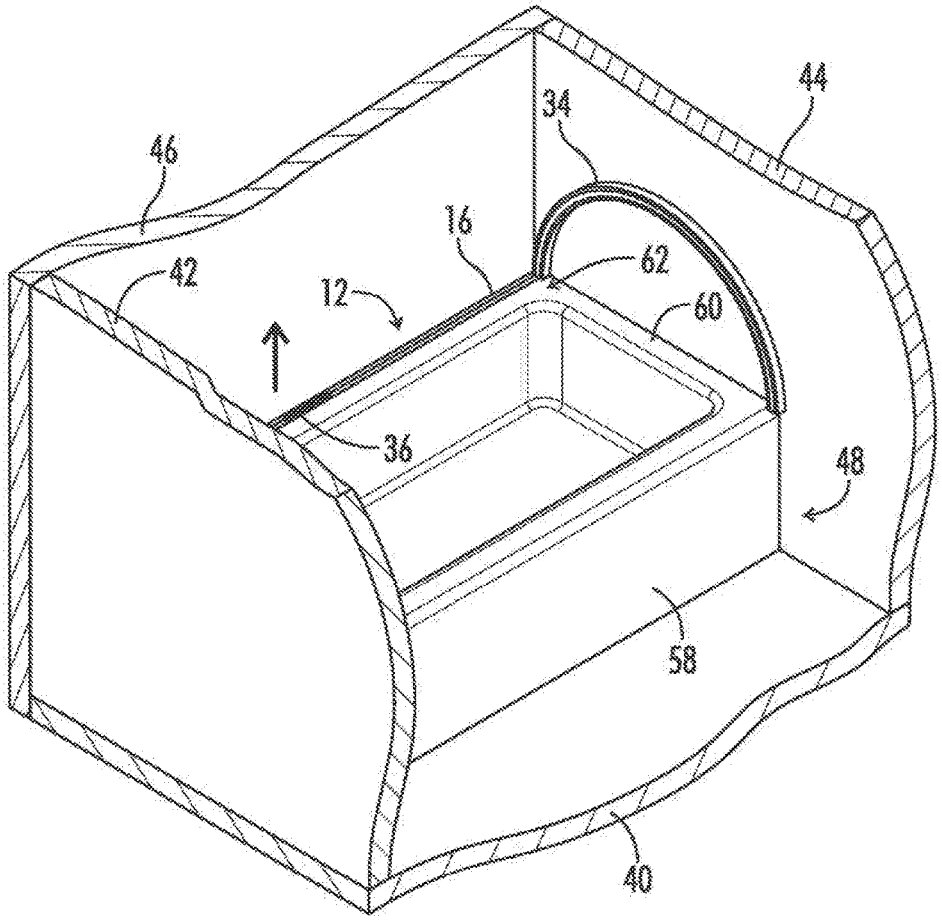
FIG. 3 illustrates a perspective view of an embodiment of a storm shield apparatus in a stowed position.

As seen in FIG. 2, in some embodiments, track 30 includes a first track section 32 and a second track section 34, shown in FIG. 3. First and second track sections are positioned at opposite axial ends of shield 12 such that a first axial shield end 22 travels along first track section 32, and a second axial shield end 24 travels along second track section 34. First and second track sections 32, 34 may be formed into corresponding end walls 42, 44 respectively positioned at the ends of the bathing structure 48. Shield 12 is rolled on a spool 56 in some embodiments at a position under tub deck 60 on bathing enclosure 48. As a user lifts handle 36, shield 12 is unrolled from spool 56 and shield 12 travels along a path defined by track 30. Track 30 includes an arcuate track forming a semi-circular path in some embodiments as shown in FIGS. 1-3. As seen in FIG. 3, in some embodiments, shield 12 extends through tub deck 60 via a tub deck opening 62 allowing passage of shield 12 from a stowed position to a deployed position. In other embodiments, shield 12 extends from a gap between the longitudinal edge of the tub deck and the rear wall 46.

Figure 13:
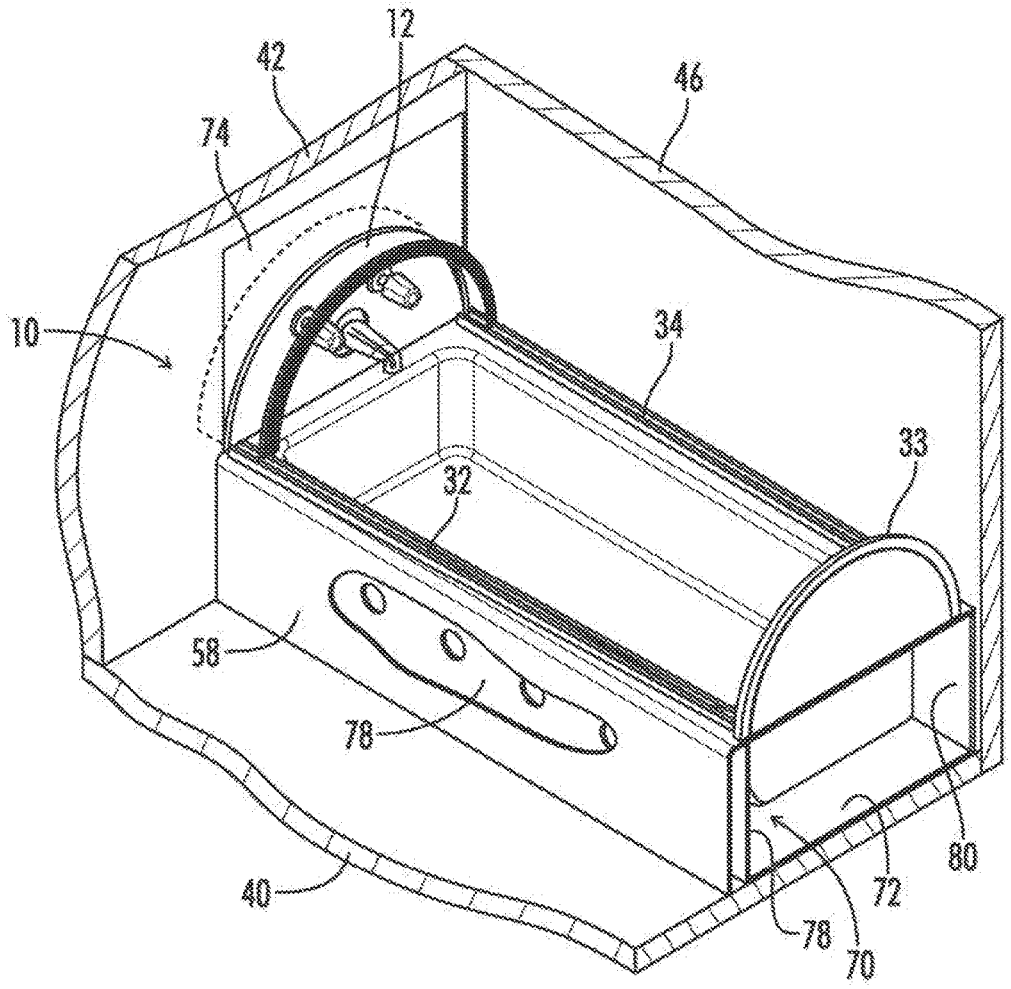
FIG. 13 illustrates a partial cross-sectional perspective view of an embodiment of a storm shield apparatus.

Shield 12 includes first and second shield edges that move along track sections. First shield edge on shield 12 includes a first axial edge 22 that moves along first track section 32, and second shield edge on shield 12 includes a second axial edge 24 that moves along second track section 34 as shown in FIGS. 2 and 3 in some embodiments. Alternatively, first shield edge on shield 12 includes a first longitudinal edge 26 that moves along first track 32, and second shield edge on shield 12 includes a second longitudinal edge 28 that moves along second track 34. as shown in FIG. 13.

Track 30 can include many configurations. In some embodiments, first and second track sections 32, 34 are recessed into first and second end walls 42, 44, respectively. In additional embodiments, first track section 32 includes a separate track member that is installed on first end wall 42 using one or more fasteners, and second track section 32 includes a separate track member that is installed on second end wall 44 using one or more fasteners. In some embodiments, each track section includes a C-shaped cross-sectional profile to retain a corresponding feature on shield 12 in a locking manner. For example, one or more corresponding rollers or track carriages extend from first axial end 22 of shield 12 and engage and travel along first track section 32. Similarly, one or more corresponding rollers or track carriages extend from second axial end 24 of shield 12 and engage and travel along second track section 34.

Figure 4A:
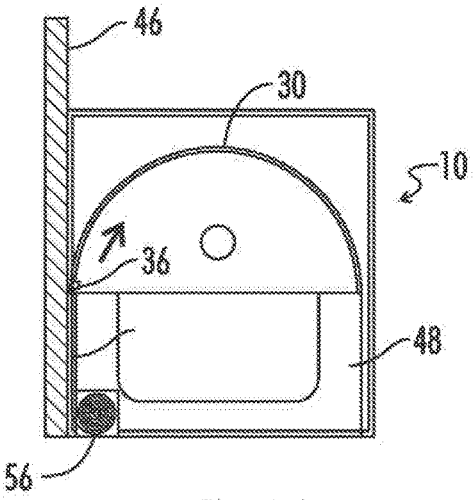
FIG. 4A illustrates a cross-sectional schematic view of an embodiment of a storm shield apparatus in a stowed position.
Figure 4B:
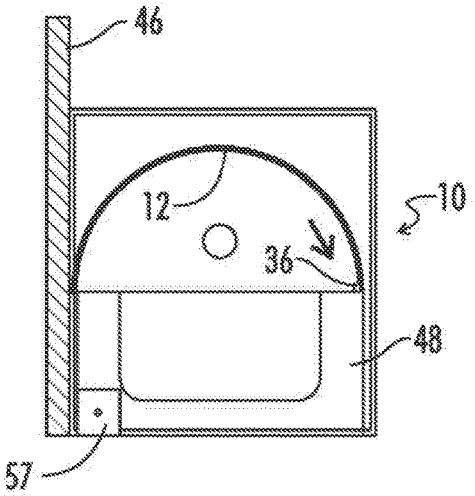
FIG. 4B illustrates a cross-sectional schematic view of an embodiment of a storm shield apparatus in a deployed position.
Figure 5:
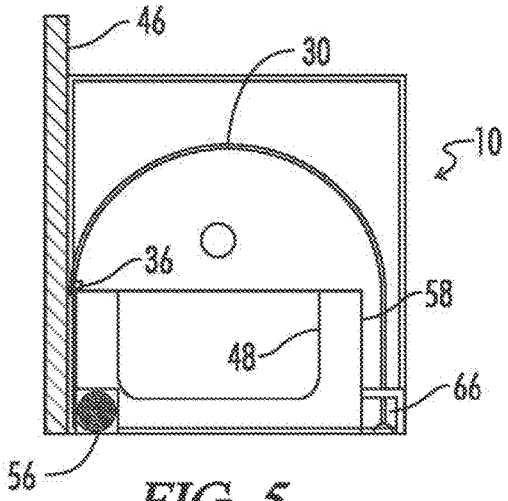
FIG. 5 illustrates a cross-sectional schematic view of an embodiment of a storm shield apparatus in a stowed position.
Figure 6:
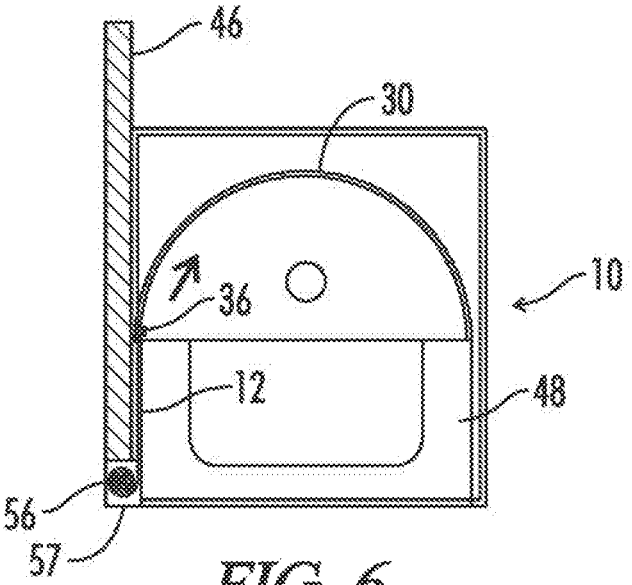
FIG. 6 illustrates a cross-sectional view of an embodiment of a storm shield apparatus in a stowed position.
Figure 7:
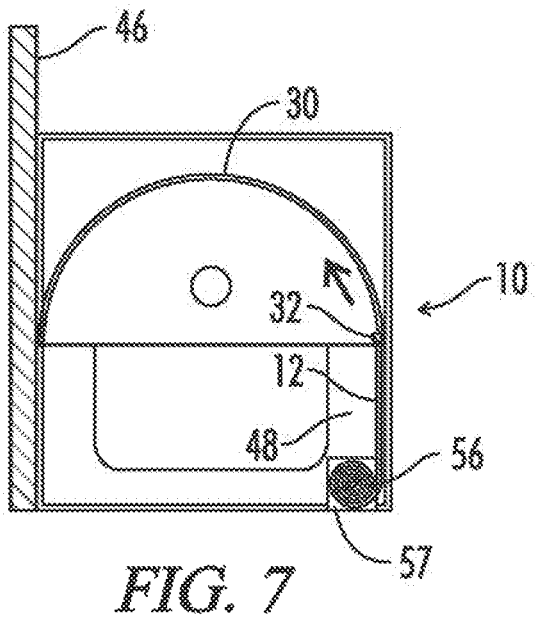
FIG. 7 illustrates a cross-sectional view of an embodiment of a storm shield apparatus in a stowed position.

Shield 12 may be deployable from either side of bathing structure 48, as seen in FIGS. 4A-7 in different configurations. As shown in FIG. 4A, shield 12 winds and unwinds on a spool 56 on the side of bathing enclosure 48 adjacent rear wall 46. Spool 56 may be housed in a longitudinal spool casing 57 in some embodiments. From this position, shield 12 may be deployed upwardly along track 30. As shield 12 travels along track 30, spool 56 unwinds and handle 36 approaches the front side of the bathing enclosure. In some applications, track 30 terminates on the tub deck at or near the top front edge of the tub on the tub deck. In other embodiments, track 30 extends to the exterior of the tub skirt 58 and travels to the floor to a shield lock 66 that receives and engages the front longitudinal edge of the shield 12 to lock the shield in place. As seen in FIG. 6, spool 56 may be positioned in some embodiments in rear wall 46. In alternative embodiment, as seen in FIG. 7, spool 56 is located in a space under the bathing structure 48 adjacent or near the tub skirt 58 on the front side of the bathing enclosure. In this embodiments, shield 12 moves along track 30 in a direction from the front side of the bathing enclosure toward the rear wall 46.

In some additional embodiments, storm shield apparatus 10 includes a two-component system including a shield 12 and a base trough 70, shown in FIGS. 8-12. Base trough 70 includes a five-sided trough having a bottom panel 72, a first side panel 78, a second side panel 80, a first end panel 74 and a second end panel 76. Each panel includes a rigid material such as a metal plate. Each panel may be rigidly joined together with adjacent panels using fasteners or welds. Trough 70 provides an internal trough cavity 84 shaped to receive the basin 54 portion of a bathing enclosure 58 such as a bathtub. Many bathing enclosures are made of molded plastic or other similar materials that offer little resistance to penetration by wind-driven debris. Shield 12 covers the space above the bathing enclosure, but the lower portion of the bathing enclosure may remain susceptible to impact by debris during a disaster. Trough 70 provides reinforcement on each side of the bathing structure from below, from the sides, and from the ends, thereby providing a protective shield for the volume enclosed by the tub basin 54.

Figure 8:
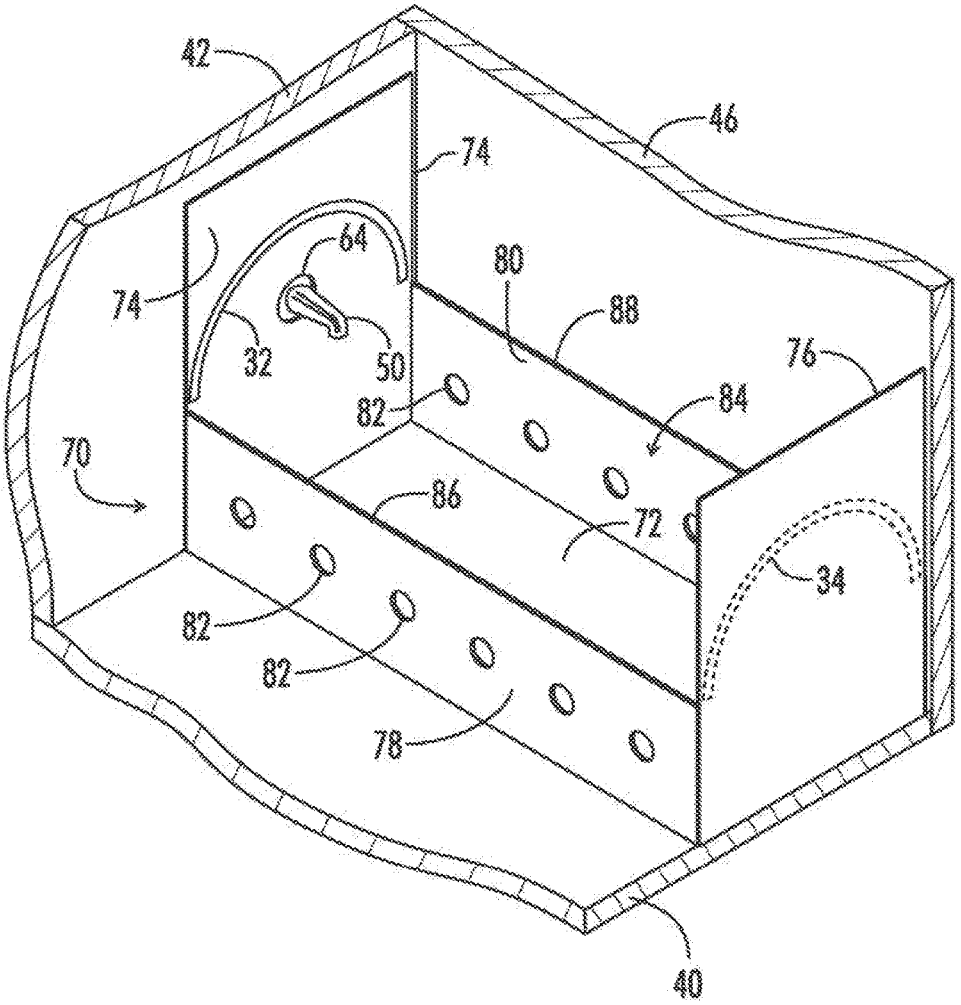
FIG. 8 illustrates a perspective view of an embodiment of a trough for use with a storm shield apparatus.
Figure 9:
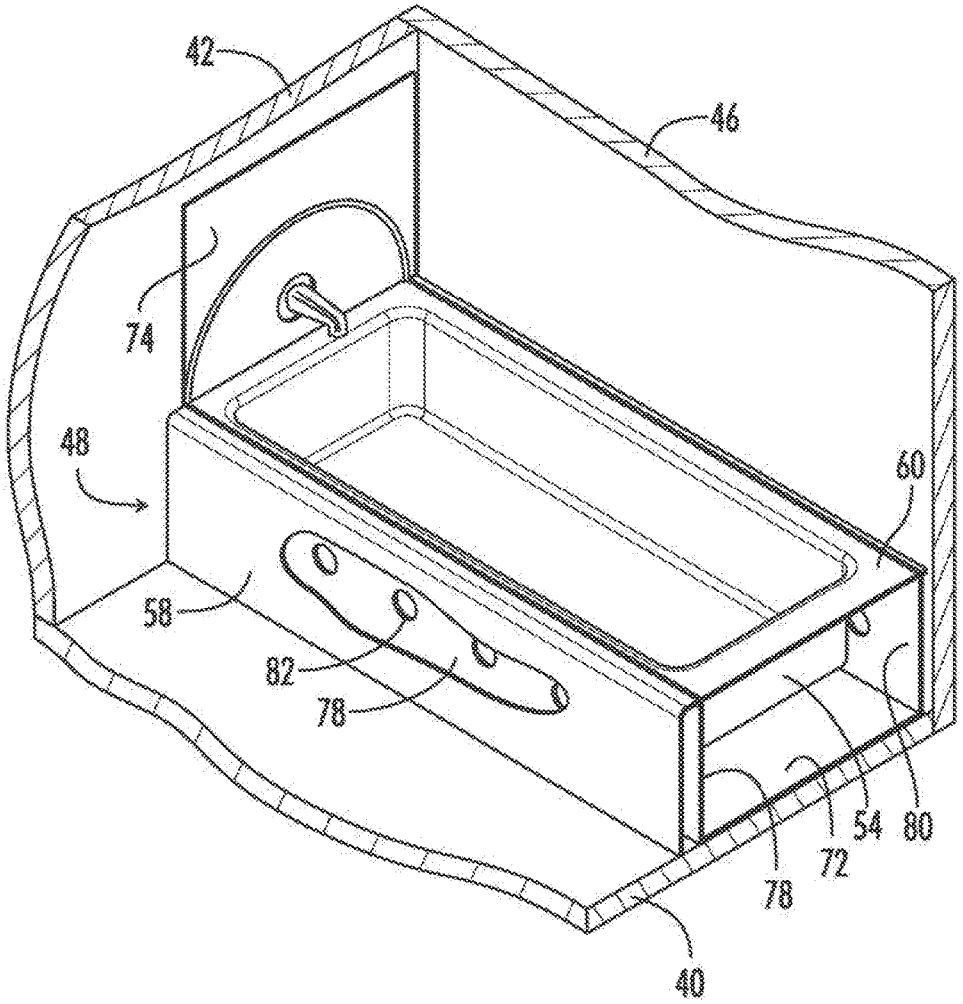
FIG. 9 illustrates a partial cross-sectional perspective view of an embodiment of a storm shield apparatus.
Figure 10:
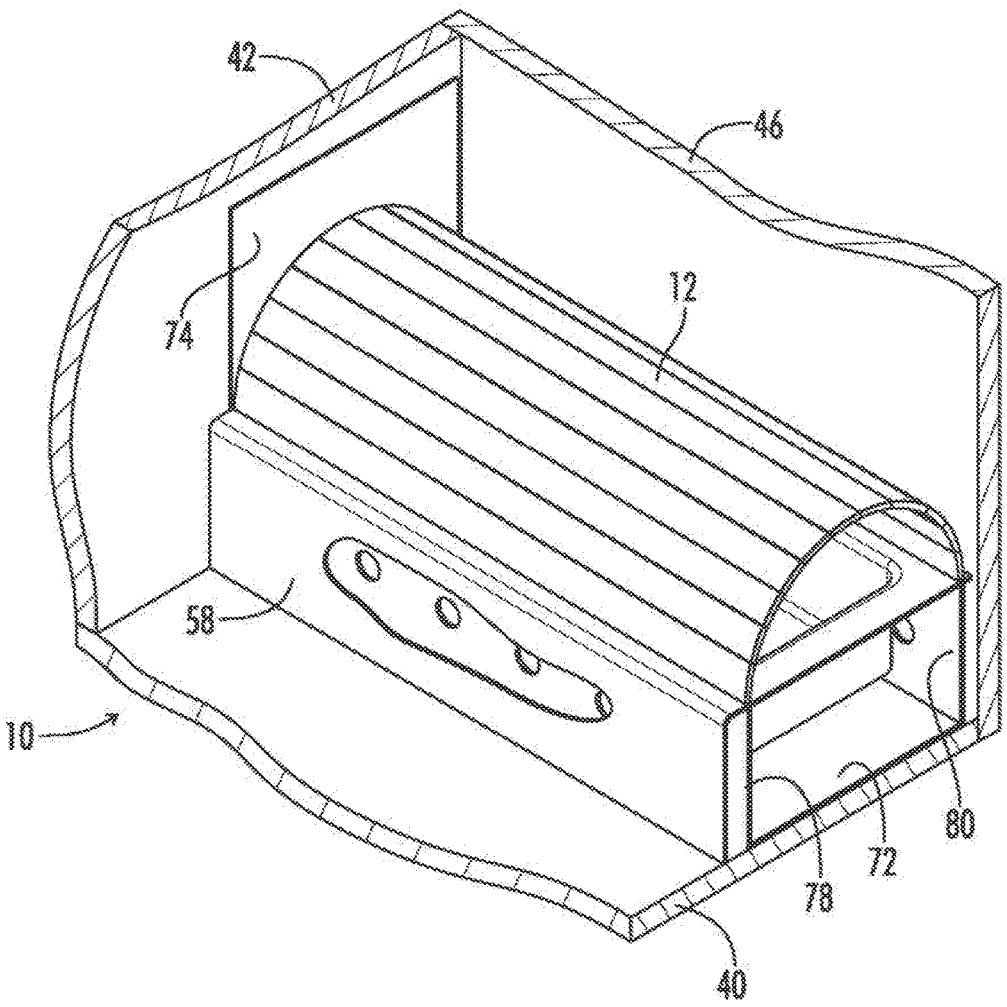
FIG. 10 illustrates a partial cross-sectional perspective view of an embodiment of a storm shield apparatus.

First side panel 78 on trough 70 includes a first upper edge 86, and second side panel 80 includes a second upper edge 88. A bathtub deck 60 may rest against the front and rear upper edges 86, 88 when a bathtub is positioned on the trough 70, as seen in FIG. 9. Trough 70 is dimensioned such that first side panel 78 is received between tub skirt 58 and tub basin 54, as shown in FIG. 9, when the bathing structure is lowered onto the trough 70. FIG. 9 and FIG. 10 are shown with partial cutaway views with the end of the trough shown as open to illustrate the internal positioning of the trough panels. However, during use, each end of trough 70 is closed by first and second end panels 74, 76 respectively, as shown in FIG. 8. Each end panel 74, 76 protects the axial ends of the tub from incident debris from those directions. Additionally, as seen in FIG. 8, each end panel 74, 76 has a height greater than the height of first and second side panels 78, 80. Shield 12 is deployable between the raised portions of first and second end panels 74, 76 as seen in FIG. 10. For example, in some embodiments, first track section 32 is disposed on first end panel 74 on trough 70, and second track section 34 is disposed on second end panel 76 on trough 70. As noted above, first track section 32 is recessed into first end panel 74 in some embodiments, and second track section 34 is recessed into second end panel 76 in some embodiments. Each track section is shaped to receive one or more corresponding rollers or track carriages disposed on the axial ends of panel 12.

Storm shield apparatus 10 may be installed in a new construction residence, or installed as a retrofit of an existing bathing structure location. In some embodiments, an existing structure such as a bathtub may be removed entirely, and trough 70 placed in the location where the bathing structure was formerly positioned. A new bathing structure including a shield 12 may be positioned in the trough 70. In some embodiments, trough 70 includes a first end panel 74 having one or more plumbing openings 64 to allow passage of faucet 50 or valve control knobs, as seen in FIG. 8.

Figure 11:
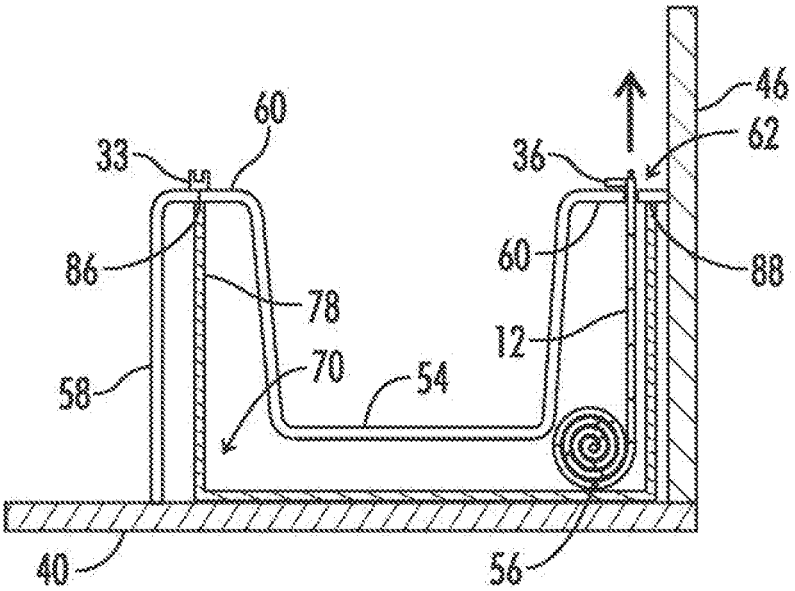
FIG. 11 illustrates cross-sectional view of an embodiment of a storm shield apparatus with a shield in a stowed position.
Figure 12:
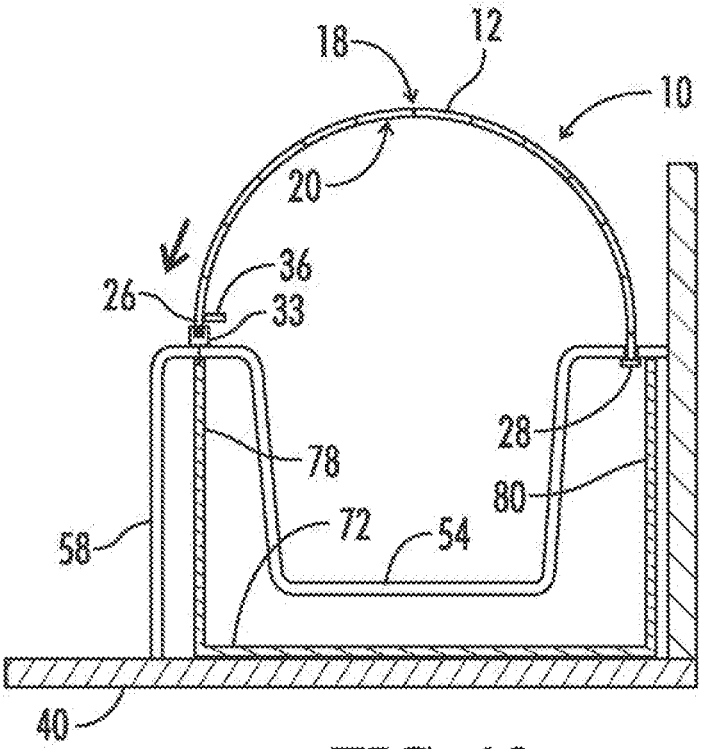
FIG. 12 illustrates a cross-sectional view of an embodiment to of a storm shield apparatus with a shield in a deployed position.

As seen in FIG. 11, shield 12 may be stowed in a position between trough 70 and tub basin 54 on spool 56. Shield 12 may be raised via handle 36 through tub deck opening 62. In some embodiments, first side panel 78 on trough 70 extends upwardly on the interior side of tub skirt 58. As such, the upper edge 86 of first side panel 78 provides support for tub deck 60. A shield receiver 33 may be positioned on tub deck 60 directly above first side panel 78. Shield receiver 33 receives and mates with a corresponding structure on the front longitudinal edge of shield 12. Shield receiver 33 is secured directly to first side panel 78 using one or more fasteners that extend through tub deck 60 in some embodiments. As seen in FIG. 12, in some embodiments shield 12 includes a rear longitudinal edge 28 including an edge stop to stop the upward travel of shield 12 during deployment. When shield 12 is engaged to shield receiver 33 in a deployed position, the volume between shield 12 and trough 70 is enclosed by rigid protective panels on trough 70 and by the shield material in shield 12.

As seen in FIGS. 8-10, trough 70 is designed to provide structural protection for one or more persons or pets positioned in tub basin 54 from the sides and from below. Trough 70 includes one or more vent holes 82 positioned on one or more panels, as seen in FIG. 8. Each vent hole allows passage of air so that persons or pets positioned in the enclosure may be able to breathe for an extended period of time.

Referring now to FIGS. 13-17, alternative embodiments of the storm shield apparatus 10 include a shield that moves longitudinally from one end of a bathing structure to the other. Shield 12 includes a segmented shield comprising a plurality of arcuate sections that slide relative to one another in a nesting or telescoping arrangement. Each section forms a semi-cylinder in some embodiments.

Figure 14:
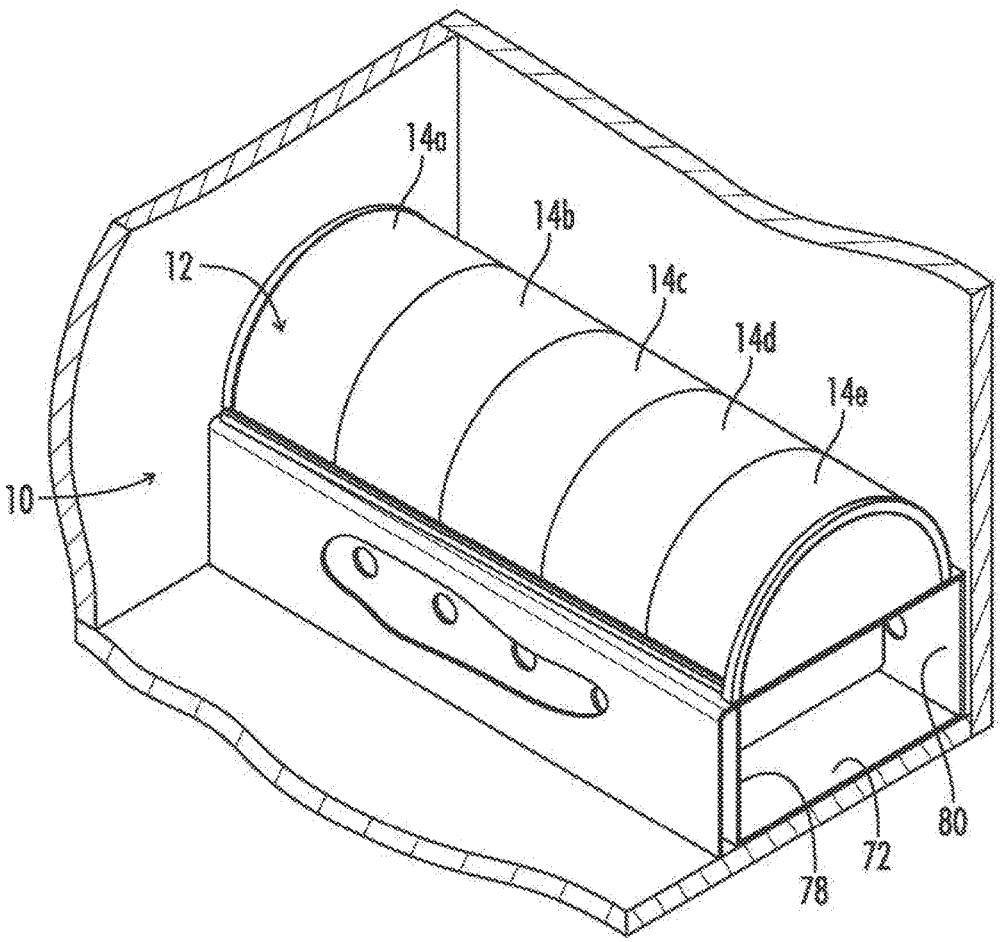
FIG. 14 illustrates a partial cross-sectional perspective view of an embodiment of a storm shield apparatus.

Referring to FIGS. 13 and 14, shield 12 includes multiple sections 14*a*, 14*b*, 14*c*, 14*d*, 14*e*. Each shield section slides along first and second tracks 32, 34. Each shield section in this embodiment includes an front longitudinal edge and a rear longitudinal edge. First track 32 is positioned in a longitudinal direction along the front upper surface of tub deck 60, and second track 34 is positioned in a longitudinal direction along the rear upper surface of tub deck 60, as seen in FIG. 13. Shield 12 may be fully or partially recessed behind first end panel 74 in the stowed position. During use, a user may pull the shield out from the stowed position such that the shield sections slide along the track members 32, 34 to a deployed position shown in FIG. 14. In some embodiments, a shield receiver 33 is positioned on second end wall 44 or second end panel 76 to receive and engage the axial edge of the end shield section to lock the shield 12 in a deployed position, as seen in FIG. 14.

Figure 15:
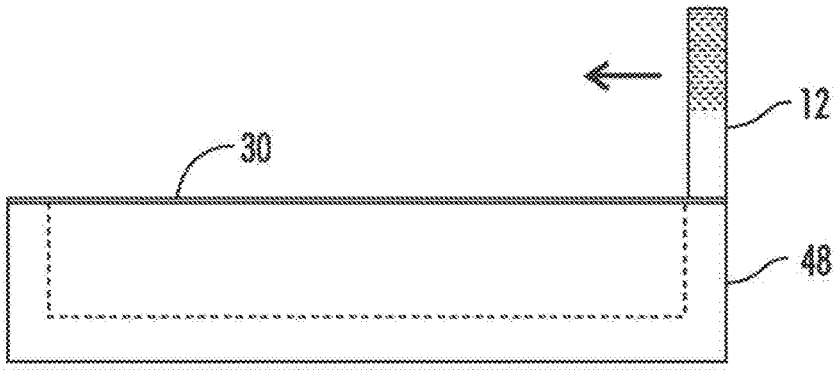
FIG. 15 illustrates a side view of an embodiment of a storm shield apparatus.
Figure 16:
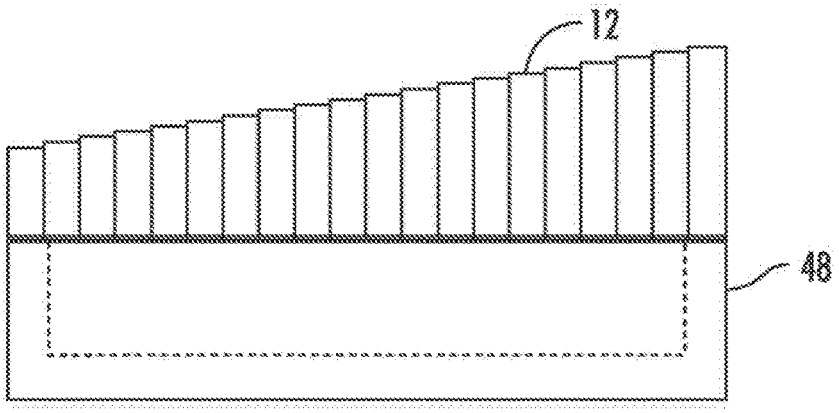
FIG. 16 illustrates a side view of an embodiment of a storm shield apparatus.
Figure 17:
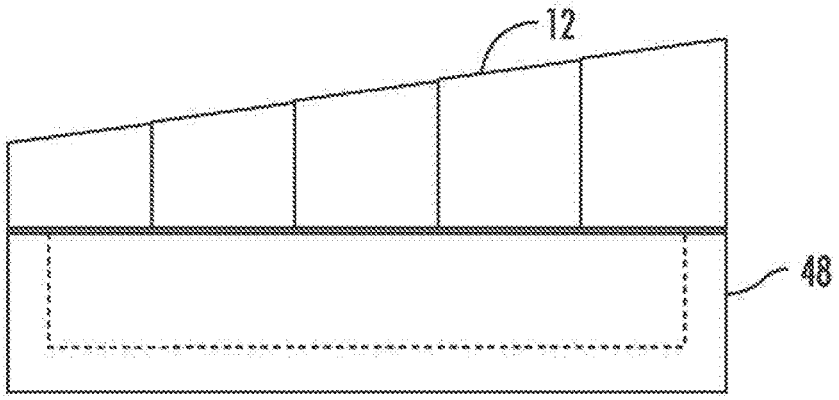
FIG. 17 illustrates a side view of an embodiment of a storm shield apparatus.

Shield 12 can include various sizes and numbers of shield sections, as seen in FIGS. 15-17. Shield sections generally nest relative to each other in a stowed position, as seen in FIG. 15 in some embodiments. When deployed, the shield sections slide relative to each other along track 30 to cover the bathing structure 48. In some embodiments, shield 12 includes three shield sections. In other embodiments, shield 12 includes four shield sections. In further embodiments, shield 12 includes five shield sections. In various other embodiments, shield 12 may include between three and thirty shield sections.

In some embodiments, trough 70 is dimensioned such that shield 12 extends from first end panel 74 to second end panel 76 and from the first side panel 78 to the second side panel 80, thereby providing a complete enclosure between the trough 70 and the shield 12.

Although the storm shield apparatus is shown in several sFigures with the bathing structure 48 being a bathtub, the storm shield apparatus 10 may be used with other types of bathing structures, including showers.

Thus, although there have been described particular embodiments of the present invention of a new and useful Storm Shield for Bathing Structure it is not intended that such references be construed as limitations upon the scope of this invention except as set forth in the following claims.

What is claimed is:

1. A storm shield apparatus, comprising:

a bathing structure comprising a tub skirt, wherein the bathing structure is disposed adjacent to a rear wall, and wherein the tub skirt is disposed opposite the rear wall;

a shield; and a track positioned on at least one end wall above the bathing structure wherein the track extends in an arcuate shape from the adjacent rear wall to the tub skirt, the track is configured to slidably receive the shield, the shield is selectively moveable between a stowed position and a deployed position, and the shield, when in the deployed position, forms an enclosed space between the shield and a top of the bathing structure.

2. The apparatus of claim 1, wherein the shield includes an arcuate shape when in the deployed position.

3. The apparatus of claim 1, wherein shield includes a multi-segment barrier.

4. The apparatus of claim 3, wherein the multi-segment barrier comprises a plurality of sections coupled at longitudinal joints.

5. The apparatus of claim 1, wherein the shield is configured to be rolled on a spool.

6. The apparatus of claim 5, wherein the spool is positioned at the adjacent rear wall of the bathing structure.

7. The apparatus of claim 1, wherein the shield is configured to engage with a shield lock that engages the shield to lock the shield in place.

8. The apparatus of claim 1, further comprising:

a trough including a first end panel, a second end panel, a first side panel, a second side panel, and a bottom panel, wherein the bathing structure is positioned on the trough between the first and second end panels.

9. The apparatus of claim 8, wherein the track comprises a first track positioned on the first end panel, and a second track positioned on the second end panel.

10. The apparatus of claim 9, further comprising a spool positioned between the bathing enclosure and the trough.

11. The apparatus of claim 10, wherein the shield is rolled on the spool when the shield is in a stowed position.

12. A storm shield apparatus, comprising:

a bathing structure;

a first track;

a second track opposite the first track; and a shield positioned on the bathing structure, the shield selectively moveable relative to the bathing structure along the first and second tracks between a stowed position and a deployed position, wherein the first track is disposed on a first end wall above the bathing structure and the second track is disposed on a second end wall above the bathing structure, each of the first track and the second track extend in an arcuate shape from a rear wall adjacent the bathing structure to a tub skirt disposed opposite the rear wall, the shield forms an enclosed space between the shield and a top of the bathing structure when the shield is in the deployed position.

13. The apparatus of claim 12, wherein the shield includes an arcuate shape when in a deployed position.

14. The apparatus of claim 13, further comprising:

a first end panel disposed on a first longitudinal edge of the bathing structure;

a second end panel disposed on a second longitudinal edge of the bathing structure opposite the first end panel;

wherein the first track is disposed on the first end panel and the second track is disposed on the second end panel.

15. The apparatus of claim 14, wherein the first track is recessed into the first end panel and the second track is recessed into the second end panel.

16. The apparatus of claim 12, wherein shield is a multi-segment barrier comprising a plurality of sections coupled at longitudinal joints.

17. A storm shield apparatus, comprising:

a bathing structure;

a shield including a multi-segment barrier and positioned on the bathing structure, the shield selectively moveable between a stowed position and a deployed position, wherein the shield extends over the bathing structure in an arcuate shape when in the deployed position, and the shield forms an enclosed space between the shield and a top of the bathing structure when the shield is in the deployed position.

18. The apparatus of claim 17, further comprising an arcuate track configured to receive the shield.

19. The apparatus of claim 18, wherein the arcuate track further comprises a first track section disposed on a first end wall and a second track section disposed on a second end wall.

20. The apparatus of claim 19, wherein the shield further comprises a first axial edge configured to move along the first track section and a second axial edge configured to move along the second track section.

* * * * *